US006694674B2

(12) United States Patent
Son

(10) Patent No.: US 6,694,674 B2
(45) Date of Patent: Feb. 24, 2004

(54) DOOR OPENING/CLOSING DEVICE

(76) Inventor: Jae-Ik Son, 266-9, Sang-In Dong, Dai-Seo Gu, DaeGu (KR)

( * ) Notice: Subject to any disclaimer, the term of this patent is extended or adjusted under 35 U.S.C. 154(b) by 82 days.

(21) Appl. No.: 10/084,440

(22) Filed: Feb. 28, 2002

(65) Prior Publication Data

US 2003/0005638 A1 Jan. 9, 2003

(30) Foreign Application Priority Data

Jul. 6, 2001 (KR) ..... 2001-40206
Nov. 7, 2001 (KR) ..... 2001-69185

(51) Int. Cl.[7] ..... E05F 11/00
(52) U.S. Cl. ..... 49/335; 49/139
(58) Field of Search ..... 49/333, 334, 335, 49/32, 137, 138, 139; 303/6.1

(56) References Cited

U.S. PATENT DOCUMENTS 5,036,620 A * 8/1991 Beran et al. ..... 49/141
5,228,239 A * 7/1993 Heo ..... 49/280
5,417,011 A * 5/1995 Keszthelyi ..... 49/334

* cited by examiner

*Primary Examiner*—Jerry Redman
(74) *Attorney, Agent, or Firm*—Wenderoth, Lind & Ponack, L.L.P.

(57) ABSTRACT

The present invention relates to a door opening/closing device installed in a door of a building to be opened/closed about a hinge fixed at one side of the door. The opening/closing device controls the door to be manually opened and closed with an automatic returning device. When the door is opened by a rotating power adjusting device of the door, an oil pusher-plate in a rotary member pushes oil in an oil reservoir so that rotation speed of oil is adjusted by the pressure of oil passing through an oil passage hole, the end of the oil pusher plate and the inside wall of the oil reservoir. The door is opened in a joggling manner but slowly closed as rotating speed of the door gradually decreases, thereby solving problems such as injury occurring at the time of closing the door. A door fixing unit securely fixes the door when the door is closed or opened so as to prevent a gap between the door and a door frame when the door is closed and securely fix the door without movement when the door is opened.

3 Claims, 12 Drawing Sheets

(a)

(b)

(c)

DOOR OPENING/CLOSING DEVICE

BACKGROUND OF THE INVENTION

1. Field of the Invention

The present invention relates to a door opening/closing device installed in a door of a building to be opened/closed about a hinge fixed at one side of the door. More particularly, in the door which is manually opened but closed by an automatic returning device, the door opening/closing device regulates the door to be opened in a joggling manner but slowly closed as rotating speed of the door gradually decreases, thereby solving problems occurring at the time of closing the door. The door is securely fixed in a closed position thereby preventing a gap which occurs between the door and a door frame as the door plays due to external force such as wind. Further, the door is securely fixed even if it is completely open.

2. Description of the Related Art

A revolving door known in the related art has a structure that the door is opened/closed in one direction while rotating about a hinge attached to one side of the door. An automatic structure of an opened door has adopted a door check fastened to both of the upper end of the door and a door frame or a coil spring connected to a hinge axis. Also, a device using a pneumatic or air cylinder has been known for the above structure. However, a conventional door opening/closing device using the foregoing structure has the following problems. In the door check which is externally mounted to the door for automatically closing the door, the door check is externally exposed and has a poor aesthetic appearance. Further, frequent failures and noises take place to the door check since a connecting rod is distanced away from the cylinder thereby suffering excessive force. In the structure that the pneumatic or air cylinder is mounted into a housing in which the door hinge is embedded, a high mounting cost is consumed while a piston of the cylinder is easily abraded preventing smooth operation. In the structure employing the coil spring, heavy noises and high failure rate take place as drawbacks.

In particular, the automatic door returning device has the following drawbacks. Although rotating speed of the door can be manually adjusted when the door is opened, rotating speed is uniform unless the door is held because the device does not have a controlling device. Therefore, frequently, the rotating door causes injuries, or a person may be caught between the door and the door frame accordingly having a damage.

A fixing system for holding the door in a position that the door is completed opened or closed does not provide intensity adjustment for fixing the door so that a door reciprocates several times about the center of the door frame before being closed instead of directly stopping at the center due to resilience of rotation of the door. This repeatedly produces gaps and the door stops only after resilience is exhausted. Further, when external force such as wind is applied, the door is slightly opened producing a gap as a drawback.

Further, also in the opened position of the door, the door is not securely fixed so that the door is readily opened under the slightest amount of force applied to the door.

SUMMARY OF THE INVENTION

Accordingly the present invention has been devised to solve the foregoing problems of the door opening/closing device of the related art.

According to the invention, when a door is opened, the door starts opening in a heavy and slow manner but is opened at a high speed due gradually increasing rotation speed. On the contrary, when the door is closed, the door stars closing in a light and fast manner but is closed in a slow and heavy manner at a final stage of closing. A returning device which operates when the door is opened/closed is so structured that only one side thereof operates according to opening/closing direction of the door, thereby enabling smooth operation or the device and without a failure. Further, the door can be securely fixed at both of closed and opened positions.

BRIEF DESCRIPTION OF THE DRAWINGS

FIGS. 9A to 9C are partial views of the door fixing unit of the invention, in which FIG. 9A illustrates that a door is closed, FIG. 9B illustrates that the door is being opened, and FIG. 9C illustrates that the door is being closed;

FIGS. 10A to 10C illustrate a configuration of a rotary disk of a door fixing unit of a door opening/closing device of the invention, in which FIG. 10A is a plan view of the rotary disk, FIG. 10B is a front elevation view of the rotary disk, and FIG. 10C is a sectional view illustrating that an actuation rod is fastened to the rotary disk.

DETAILED DESCRIPTION OF THE PREFERRED EMBODIMENT

Figure 1:
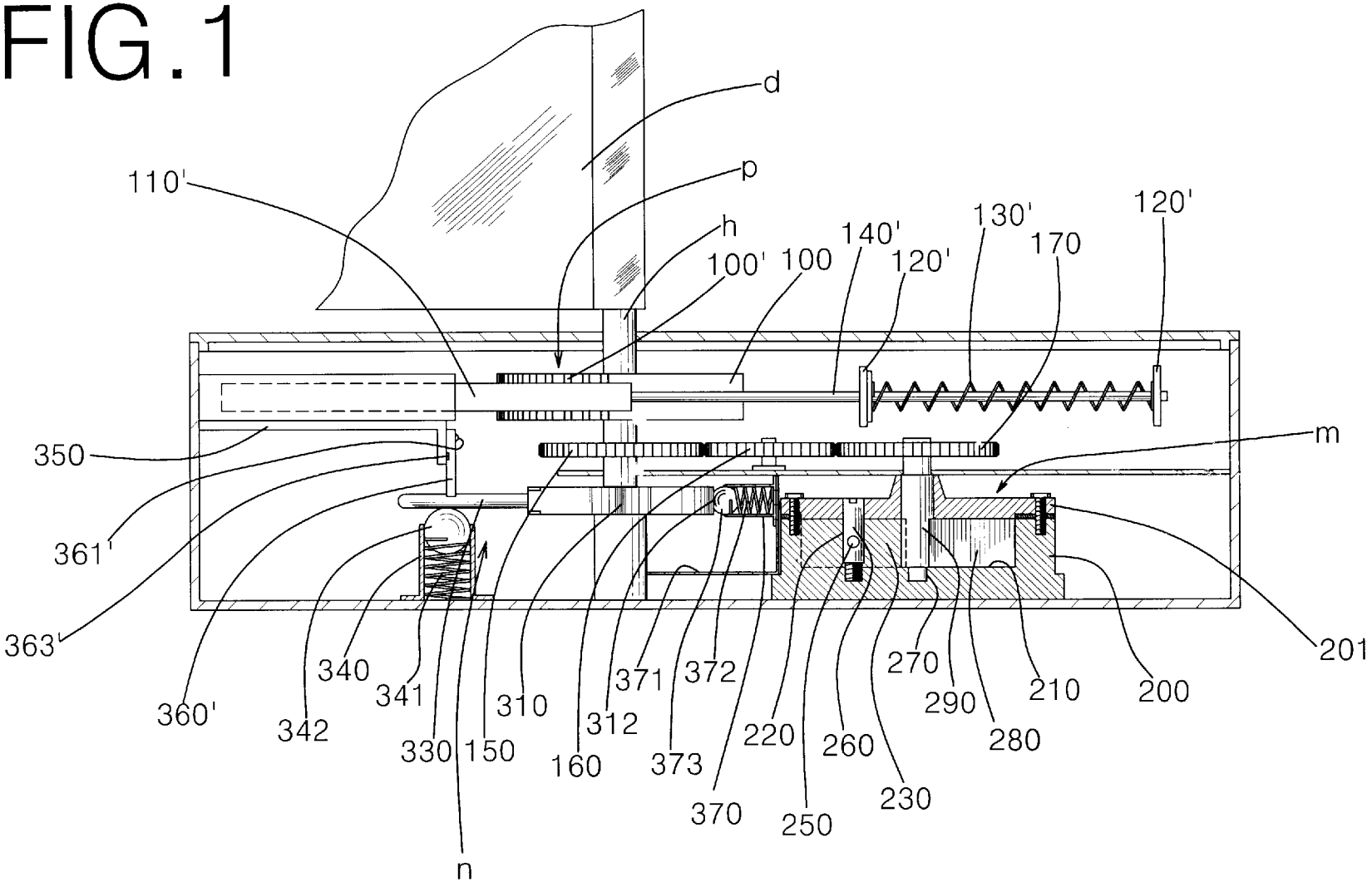
FIG. 1 is front elevation view illustrating an entire configuration of the invention.

In a door d which is opened/closed while rotating about a hinge h, a door opening/closing device is comprised of a power transmission unit p, a door rotary power controlling unit m and a door fixing unit n.

The power transmission unit p comprises a driving gear 100 axially installed at the upper part of the hinge h and having an indent portion 100' in the half of a circumferential wall thereof, rack gears 110 and 110' meshed into the indent portion 100' of the driving gear 100 in front and rear of the driving gear 100, actuation rods 140 and 140' extended from the rack gears 110 and 110' having brackets 120 and 120' attached thereto and door-returning springs 130 and 130' elastically installed between the brackets 120 and 120', the first power transmission gear 150 mounted in the middle of the hinge h, the second power transmission gear 160 cooperatively meshed into the first power transmission gear 150, and the third power transmission gear 170 cooperatively meshed into the second power transmission gear 160.

The door rotary power controlling unit m comprises a housing body 200 fixedly mounted in the lower part of the third power transmission gear 170 and having a circular oil reservoir 210 recessed eccentrically from a central point t, an oil barrier wall 230 extended toward the center of the oil reservoir 210 from a portion of the inside wall of the oil reservoir 210 and having a vertically perforated hole 220, an oil passage hole 240 perforated to pass through the hole 220 via the front and rear faces of the oil barrier wall 230, an oil passage adjusting member 260 inserted into the hole 220 and having an oil passage adjusting hole 250 perforated thereto, an axial hole 270 perforated in a central portion of the oil reservoir 210, a rotary member 290 inserted into the axial hole 270 at the lower end and having an oil pusher plate 280 at one side wall, semi-circular oil reservoirs 211 and 211' defined by the oil barrier wall 220 and the oil pusher plate 280, and a cover 201 put on the housing body 200.

The door fixing unit n comprises a rotary disk 300 fixedly mounted to the lower part of the hinge h to rotate in a rotating direction of the hinge and having recesses 310, 311 and 312 formed in the front, rear and right sides, respectively, an actuation rod receiving chamber 320 formed in the left side of the rotary disk 300, an actuation rod 330 so received in the actuation rod receiving chamber 320 to be elevated for a predetermined distance, an actuation rod backing member 340 mounted in the lower place of the actuation rod 330 and having a steel ball 342 elastically supported by a spring 341, actuation rod pressing members 360 and 360' pivotally fastened to the bracket 350 above the actuation rod 330 via support axes 361 and 361', having actuation rod pressing faces 362 and 362' in the lower ends and supported by stoppers 363 and 363' at the outsides, and a rotary disk pressure-holding member 370 fixed to a bracket 371 on the right side of the rotary disk 300 and having a steel ball 373 elastically supported by a spring 372 to be settled into the recesses 310 to 312 of the rotary disk 300.

Figure 7:
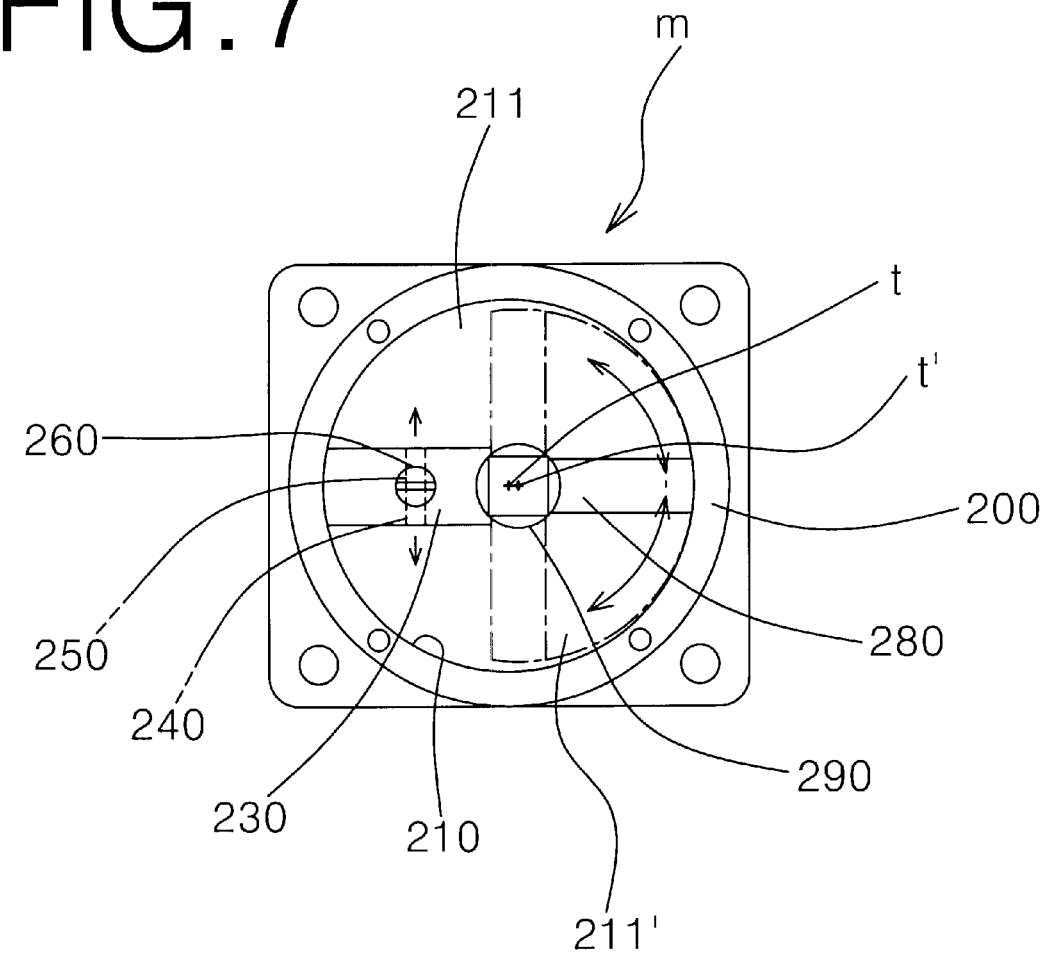
FIG. 7 is a plan view illustrating a rotary power controlling unit of a door opening/closing device according to an alternative embodiment of the invention.

FIG. 7 illustrates a rotary power controlling unit m according to alternative embodiment of the invention, in which a rotary member 290 is axially installed about the central point t' thereof eccentric from the central point t of a oil reservoir 210.

Figure 8:
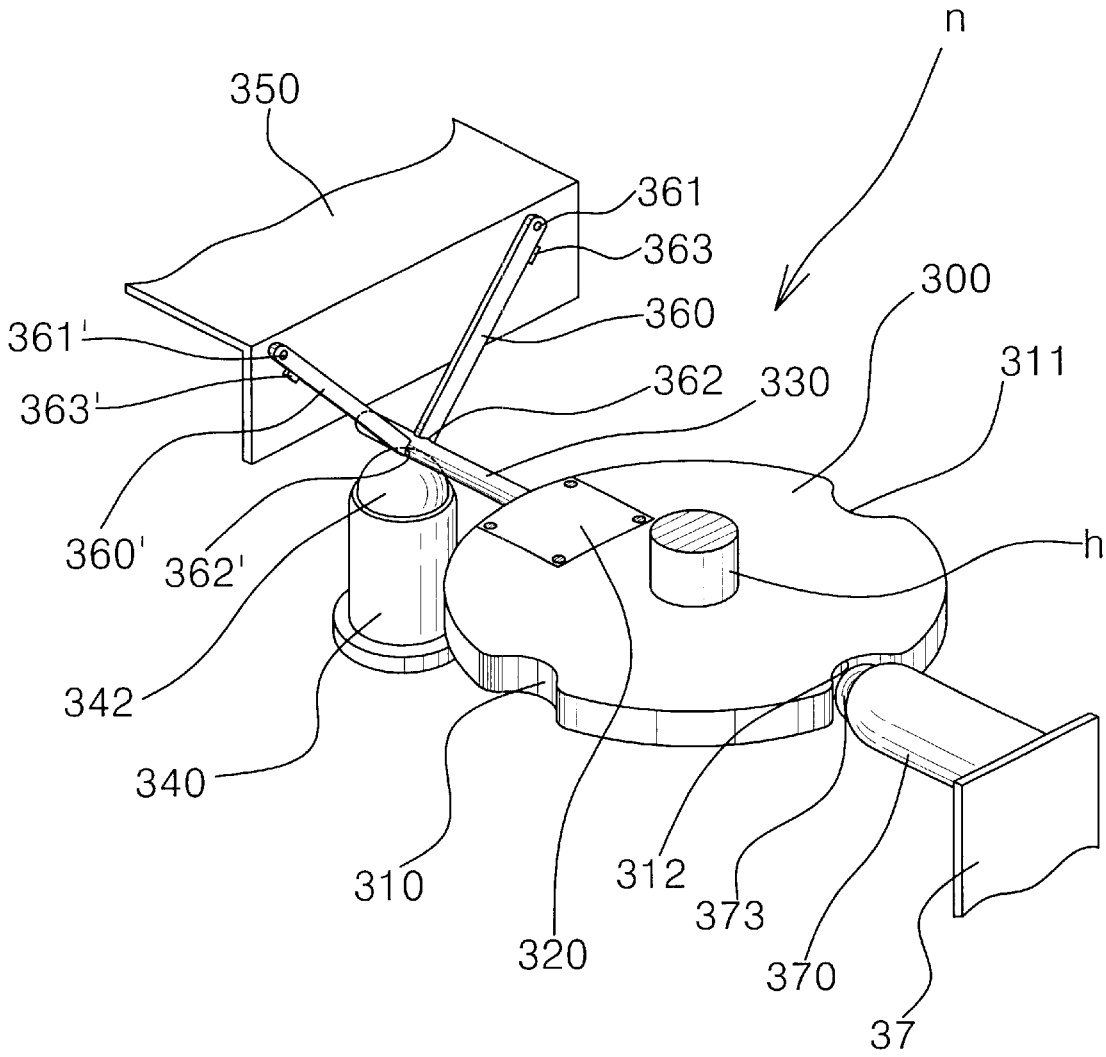
FIG. 8 is a perspective view illustrating a door fixing unit a door opening/closing device of the invention.

FIG. 8 illustrates a receiving structure of an actuation rod in a door fixing unit according to another alternative embodiment of the invention, in which an incision 320' formed in a rotary disk 300 and an actuation rod 330' inserted into the incision 320' are so fastened via a fastening bolt 331 that the actuation rod 330' can be vertically pivoted for a predetermine distance.

Operations of the invention configured as above will be described as follows.

Figure 2:
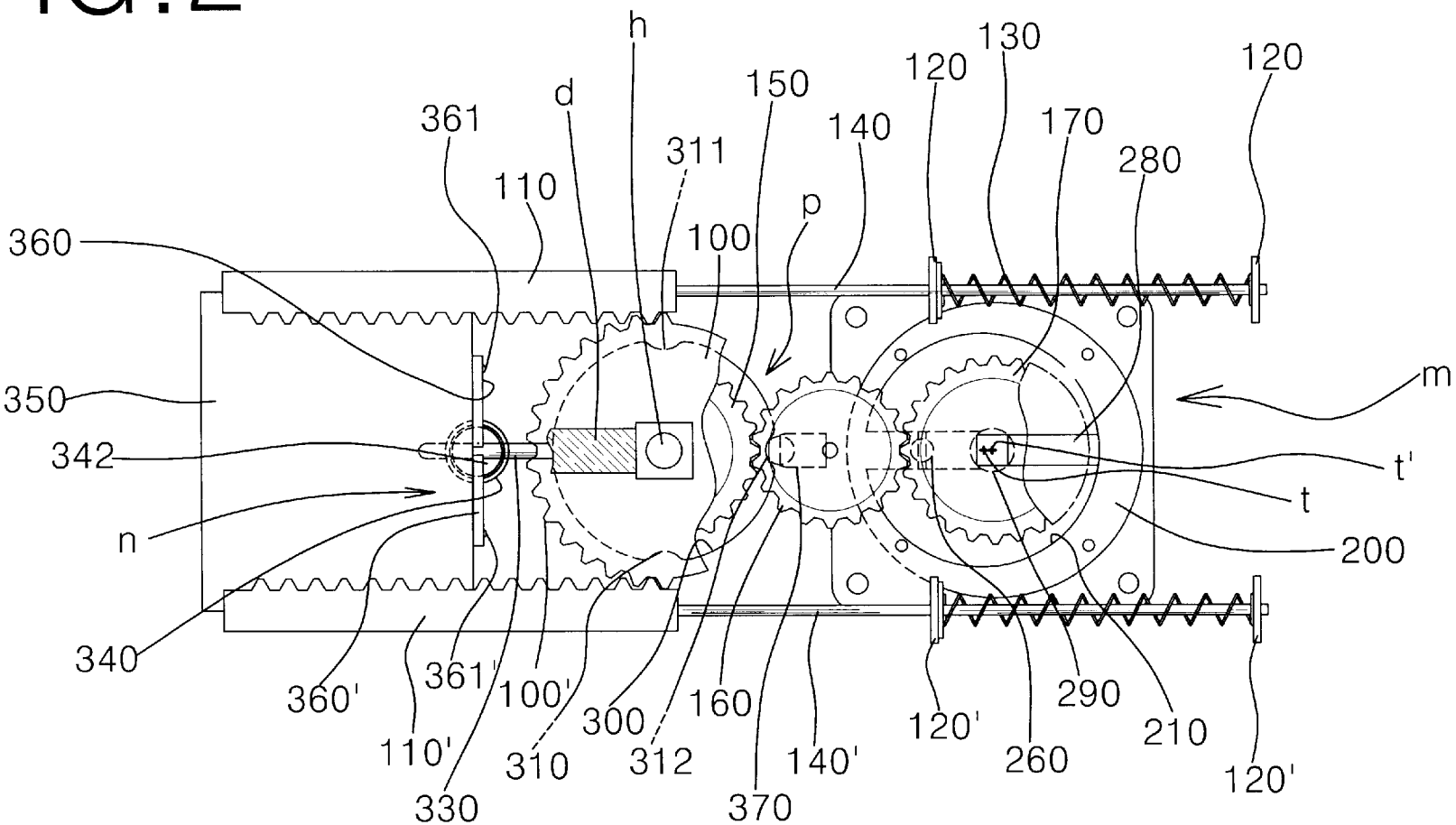
FIG. 2 is a plan view illustrating an entire configuration of the invention.
Figure 3:
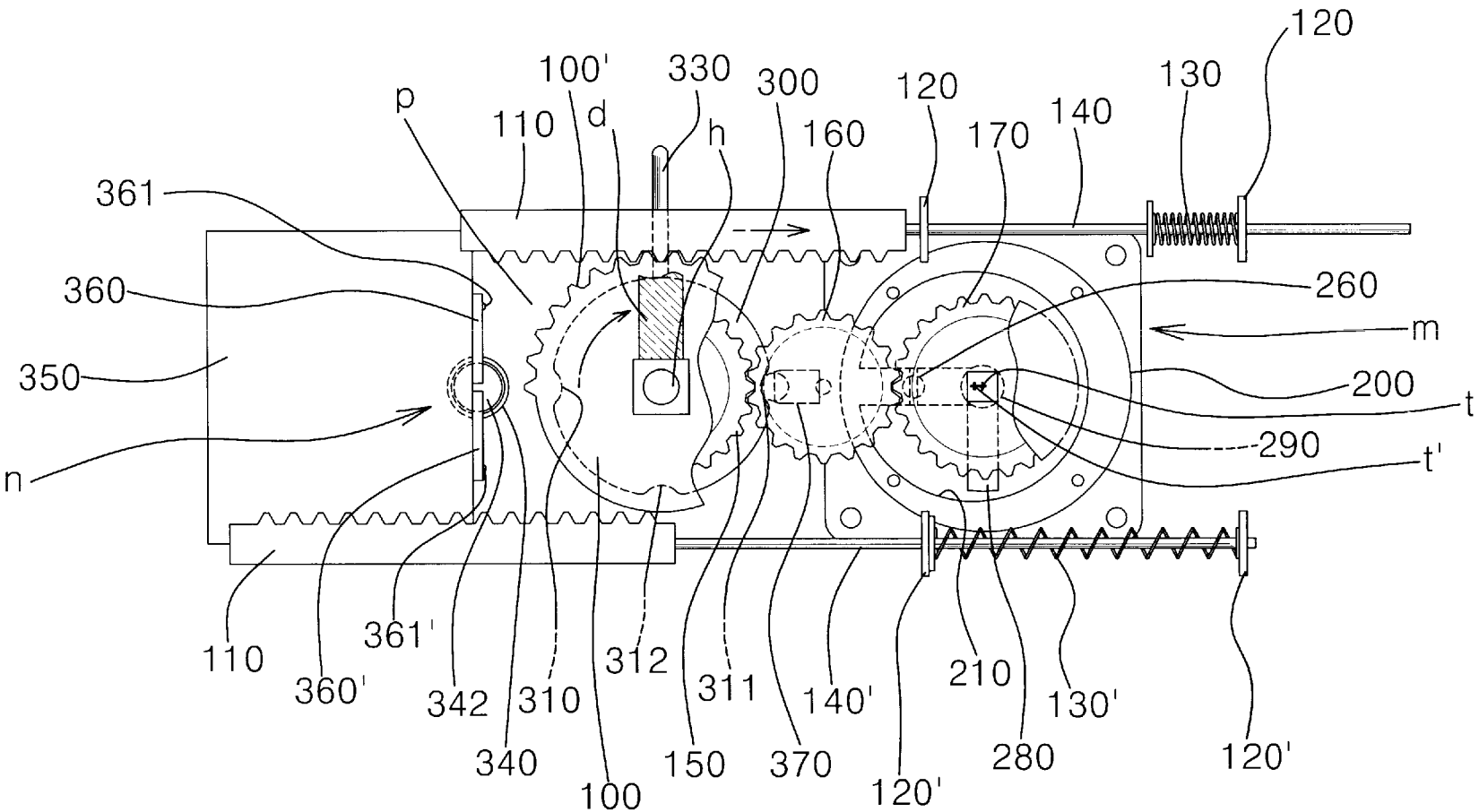
FIG. 3 is a plan view illustrating an opened position of a door of the invention.
Figure 4:
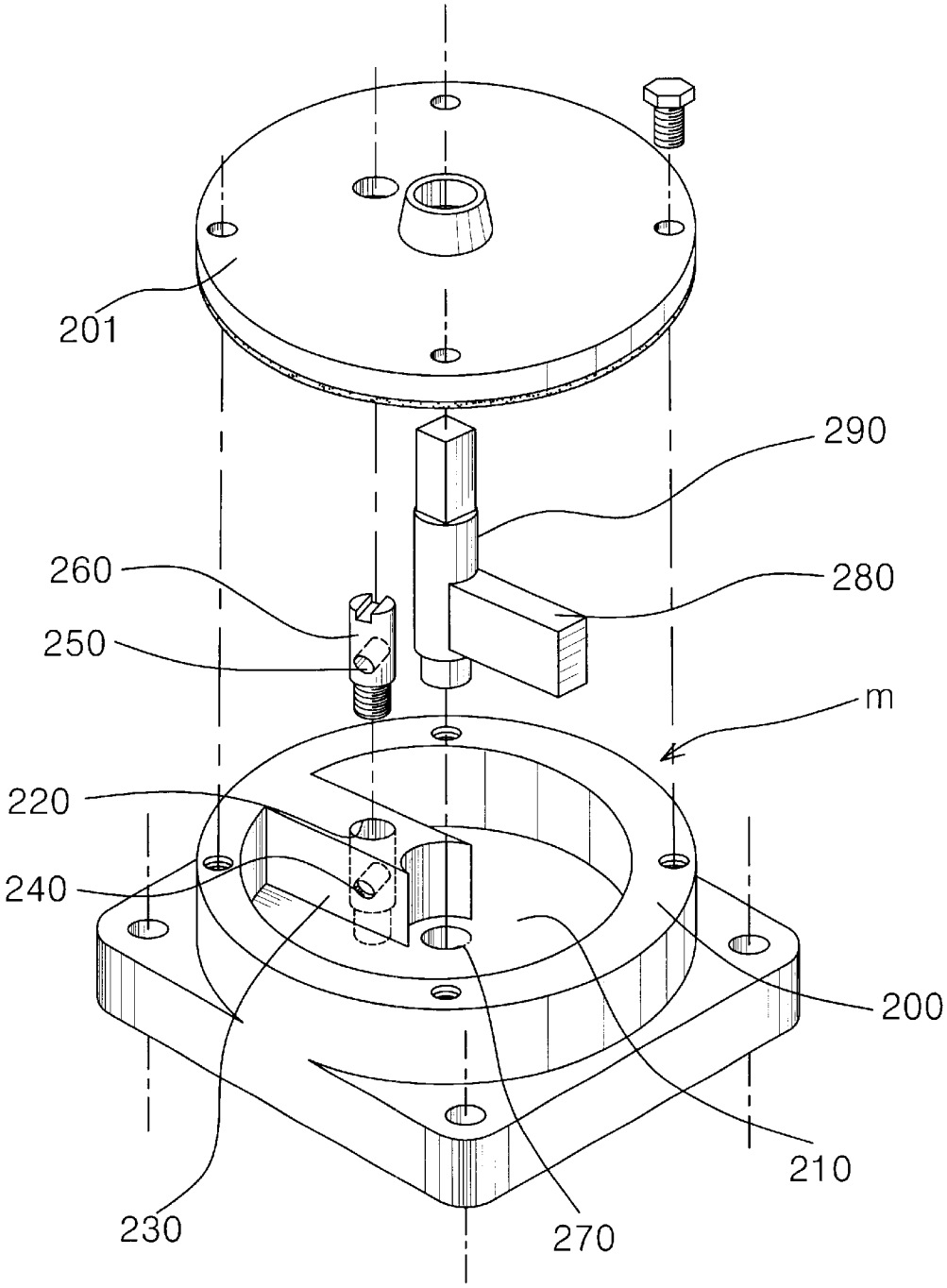
FIG. 4 is an exploded perspective view illustrating a rotary power controlling unit of a door opening/closing device of the invention.
Figure 5:
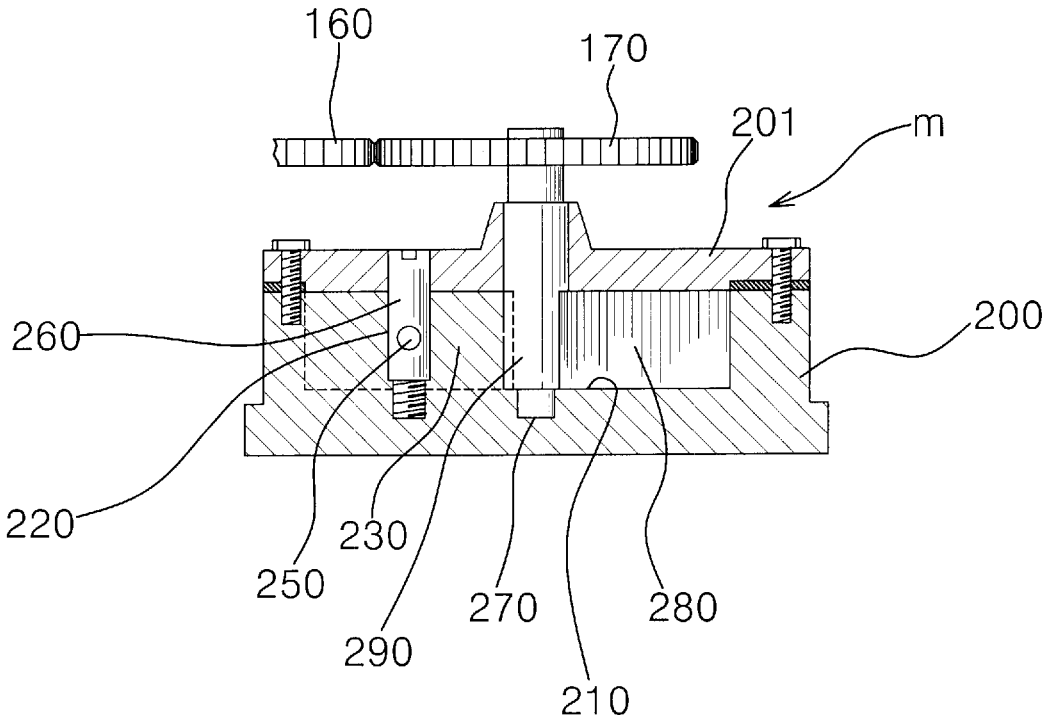
FIG. 5 is a longitudinal sectional view illustrating a rotary power controlling unit of a door opening/closing device of the invention.

FIGS. 1 and 2 illustrate that the door d is closed, and FIG. 3 illustrates that the door d is opened. When the door d is pushed, the door hinge h is rotated causing the driving gear 100, the first power transmission gear 150, the second power transmission gear 160 and the third power transmission gear 170 fixed to the hinge h to rotate. When the door starts to open from the position shown in FIGS. 1 and 2, the rotary disk 300 mounted to the lower part of the door hinge h rotates. In FIGS. 1 and 2 again, the actuation rod 330 fixed to the rotary disk 300 is fixed among the pressing faces 362 and 362' of the actuation rod pressing members 360 and 360' and the steel ball 342 elastically supported to the actuation rod backing member 340 by an elastic force of the spring 314. Now, rotary power of the door d releases the actuation rod 330 from among the pressing faces 362 and 362' of the actuation rod pressing members 360 and 360' and the steel ball 342. Since the outsides of the actuation rod pressing members 360 and 360' are supported by the stoppers 363 and 363', when the actuation rod 330 moves downward pressing the steel ball 342 while the actuation rod pressing members 360 and 360' are fixed without movement, the spring 341 supporting the steel ball 342 is contracted causing the steel ball 342 to move downward to the position shown in FIG. 9B so that the actuation rod 330 is released. When the actuation rod 330 is released as above, the rotary disk 300 is rotated.

Figure 6:
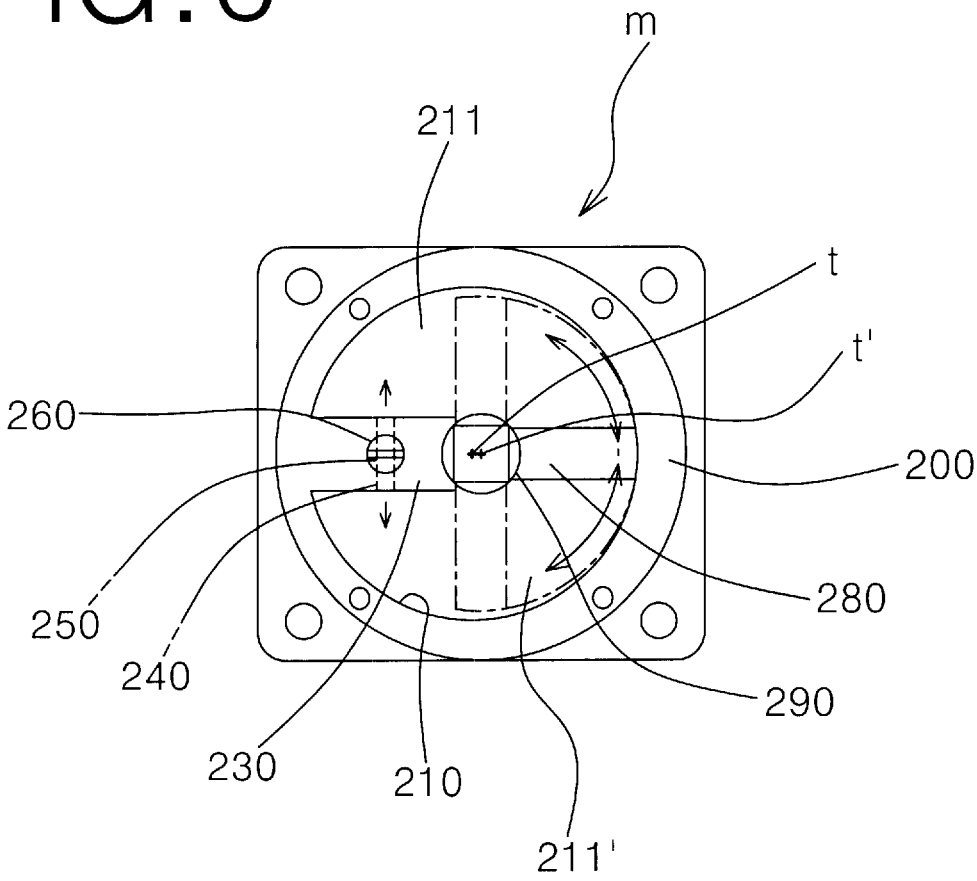
FIG. 6 is a plan view illustrating a rotary power controlling unit of a door opening/closing device of the invention.

At the same time, the rotary power adjusting unit m is operated, in which the oil pusher plate 280 of the rotary member 290 pushes oil in the oil reservoir 210 in a rotating direction as the rotary member 290 cooperating with the third power transmission gear 170 rotates. In the closed position of the door, when the outer end of the oil pusher plate 280 moves in the rotating direction as closely contacted with the oil reservoir 210 as shown in FIG. 6, the inside wall of the oil reservoir 210 and the end of the oil pusher plate 280 are gradually distanced to increase the amount of oil passage due to the eccentric formation of the oil reservoir 210, thereby rotating the door lightly.

Oil passes through the oil passage hole 240 perforated in the oil barrier wall 230 and the oil passage adjusting hole 250 perforated in the oil passage adjusting member 260, in which the oil passage adjusting member 260 is rotated to adjust the amount of oil passage so that rotating speed of the door is adjusted even if the same amount of force is applied to the door.

Figure 9:
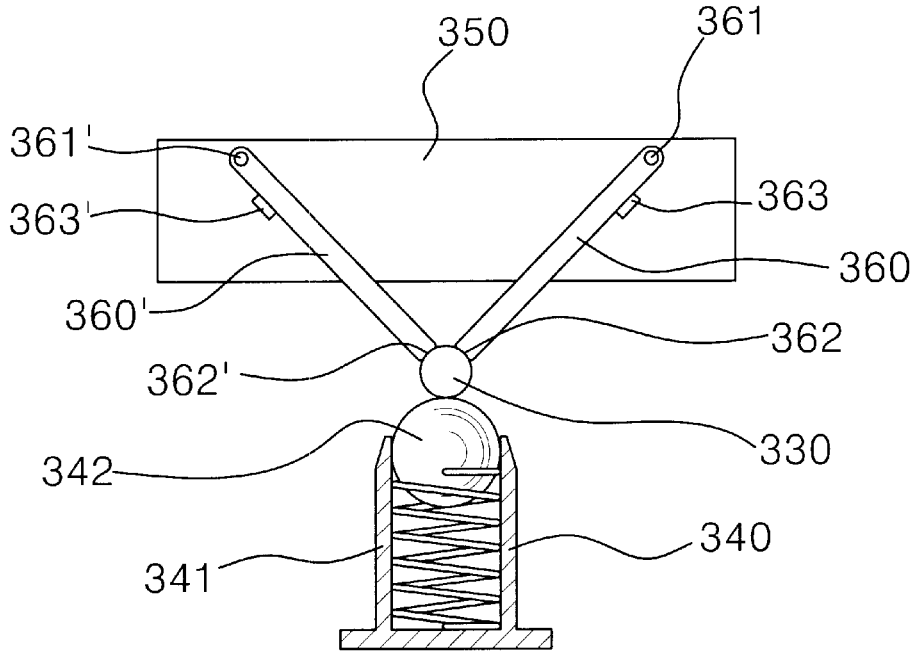
Figure 9:
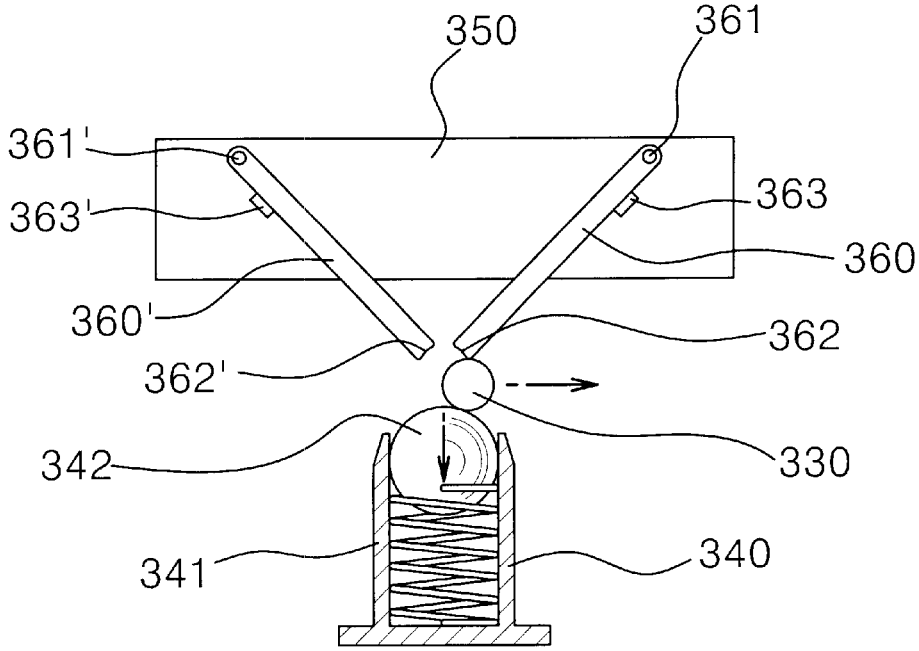
Figure 9:
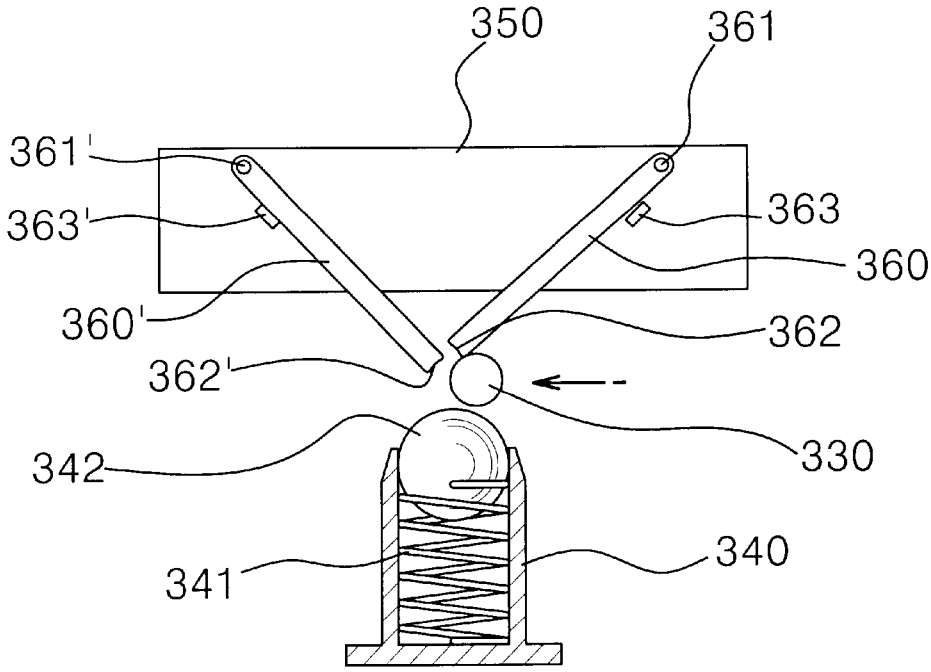
Figure 10:
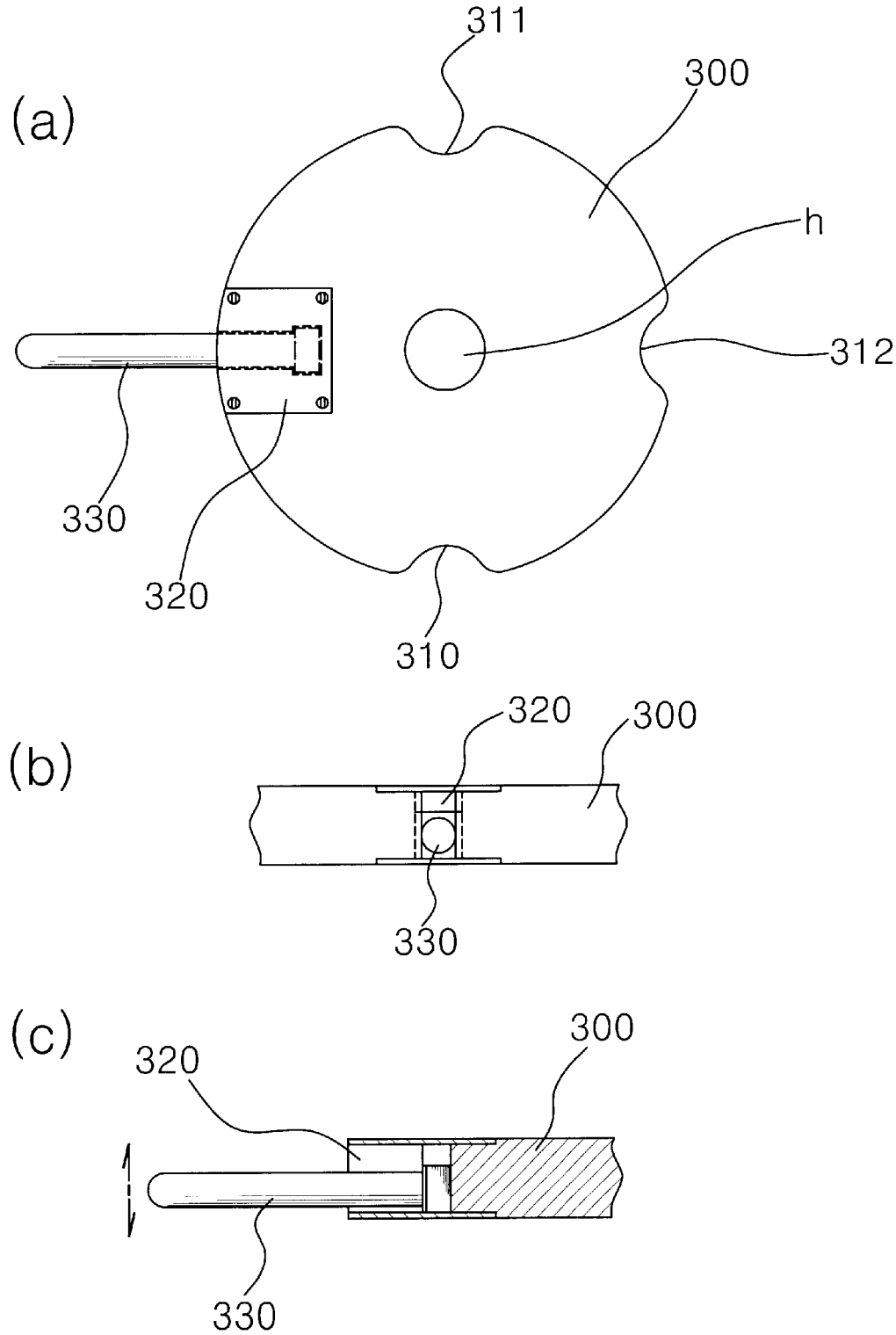
Figure 11:
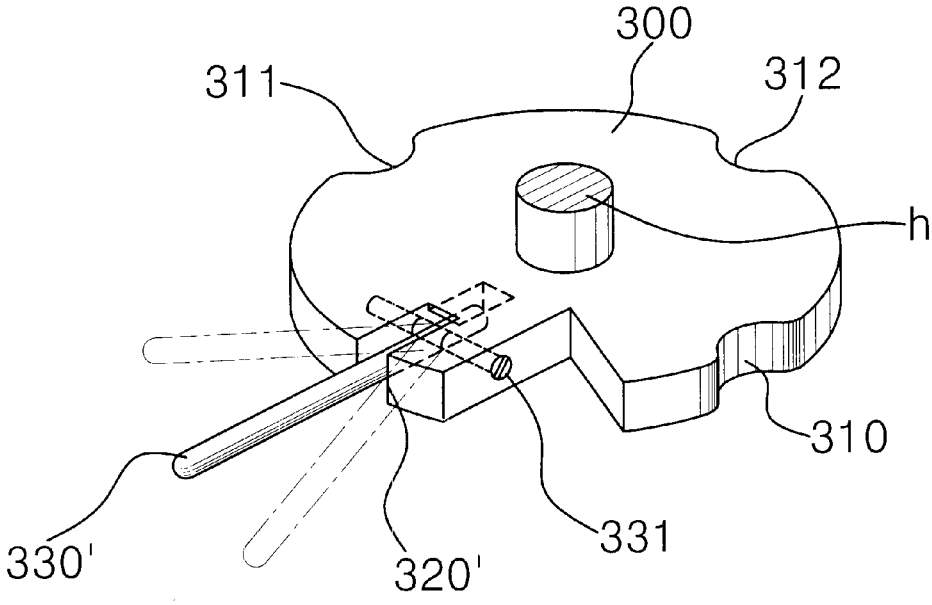
FIG. 11 is a perspective view illustrating a rotary disk according to another alternative embodiment of the invention.

In the completely opened position of the door d, as the steel ball 373 of the rotary disk pressure-holding member 370 is settled into the recess of the rotary disk 300 as shown in FIG. 2, the door is not closed easily. If the door is closed by applying force, the recess 311 of the rotary disk 300 is released from the steel ball 373 causing the rack gear 110 to return to the original position due to repulsive force of contracted the door-returning spring 130. Then, the driving gear 100 meshed to the rack gear 110 is rotated to automatically close the door. On the contrary to the opening, when the door is closed, the oil pusher plate 280 is pressed from oil as the interval between the end of the oil pusher plate 280 and the inside wall of the oil reservoir 210 is gradually narrowed. Then, the door is closed slowly as rotation of the door is slowed down, thereby preventing injuries occurring due to the door. In final closing position of the door, as shown in FIG. 9C, when the actuation rod 330 fastened to the rotary disk pushes the actuation rod pressing member 360, the actuation pusher member 360 is lightly rotated about the support axis 361. Then, the actuation rod 330 advances among the actuation rod pusher members 360 and 360' and the steel ball 342. Since the actuation rod 330 is fixed when the door is closed as above, the door is closed without movement.

Referring to the fastening structure of the actuation rod in the door fixing unit of the invention, while the actuation rod 330 is so fastened to be elevated in a horizontal position, according to the another embodiment of the invention, the actuation rod 330' is fastened by the fastening bolt 331 so as to be vertically elevated about the fastening bolt 331.

According to the invention having the foregoing configuration and the operations, artificial force is applied to open the door while the door is automatically closed. The door is opened lightly as rotating speed of the door is accelerated due to operation of the rotary power adjusting unit, whereas the door is slowly closed as rotating speed gradually slows down. Therefore, the door is smoothly opened/closed while being securely fixed in both of the opened and closed positions.

What is claimed is:

1. A door opening/closing device in a door which is opened/closed while rotating about a hinge, the device comprising:

a power transmission unit comprising a driving gear axially installed at an upper part of the hinge and having an indent portion in a half of a circumferential wall thereof, rack gears meshed into said indent portion of said driving gear in front and rear of said driving gear, first actuation rods extended from said rack gears having brackets attached thereto and door-returning springs elastically installed between said brackets, a first power transmission gear mounted in a middle of the hinge, a second power transmission gear cooperatively meshed into said first power transmission gear, and a third power transmission gear cooperatively meshed into said second power transmission gear;

a door rotary power controlling unit comprising a housing body fixedly mounted in a lower part of said third power transmission gear and having a circular oil reservoir recessed eccentrically from a central point, an oil barrier wall extended toward the center of said oil reservoir from a portion of the inside wall of said oil reservoir and having a vertically perforated hole, an oil passage hole perforated to pass through said hole in said oil barrier wall via front and rear faces of said oil barrier wall, an oil passage adjusting member inserted into said hole in said oil barrier wall and having an oil passage adjusting hole perforated thereto, an axial hole perforated in a central portion of said oil reservoir, a rotary member inserted into said axial hole at a lower end and having an oil pusher plate at one side wall, semi-circular oil reservoirs defined by said oil barrier wall and said oil pusher plate, and a cover put on said housing body; and a door fixing unit comprising a rotary disk fixedly mounted to a lower part of the hinge to rotate in a rotating direction of the hinge and having recesses formed in front, rear and right sides, respectively, an actuation rod receiving chamber formed in the left side of said rotary disk, a second actuation rod so received in said actuation rod receiving chamber to be elevated for a predetermined distance, an actuation rod backing member mounted in a lower place of said second actuation rod and having a steel ball elastically supported by a spring, actuation rod pressing members pivotally fastened to one of said brackets above said second actuation rod via support axes, having actuation rod pressing faces in lower ends and supported by stoppers, and a rotary disk pressure-holding member fixed to a bracket on the right side of said rotary disk and having a steel ball elastically supported by a spring to be settled into said recesses of said rotary disk.

2. The door opening/closing device according to claim 1, wherein said rotary member of said rotary power controlling unit is axially provided about a central point of said rotary member eccentric from a central point of said oil reservoir.

3. The door opening/closing device according to claim 1, wherein said rotary plate of said door fixing unit comprises an incision, a third actuation rod inserted into said incision and a fastening bolt for fastening said third actuation rod with said incision so that said third actuation is vertically pivotal for a given distance.

* * * * *